US009382777B2

(12) United States Patent
Pettersen et al.

(10) Patent No.: US 9,382,777 B2
(45) Date of Patent: Jul. 5, 2016

(54) TOOL FOR INSTALLING UNITS IN A WELL

(75) Inventors: Stâle Pettersen, Sandnes (NO); Erling Kleppa, Jørpeland (NO); Trond Kvasnes, Sandnes (NO)

(73) Assignee: Petroleum Technology Company AS, Stavanger (NO)

( * ) Notice: Subject to any disclaimer, the term of this patent is extended or adjusted under 35 U.S.C. 154(b) by 660 days.

(21) Appl. No.: 13/519,137

(22) PCT Filed: Jan. 26, 2011

(86) PCT No.: PCT/NO2011/000029
§ 371 (c)(1),
(2), (4) Date: Aug. 20, 2012

(87) PCT Pub. No.: WO2011/093717
PCT Pub. Date: Aug. 4, 2011

(65) Prior Publication Data

US 2012/0305235 A1 Dec. 6, 2012

(30) Foreign Application Priority Data

Jan. 26, 2010 (NO) ..... 20100127

(51) Int. Cl.
*E21B 34/02* (2006.01)
*E21B 33/068* (2006.01)

(52) U.S. Cl.
CPC ..... *E21B 34/02* (2013.01); *E21B 33/068* (2013.01)

(58) Field of Classification Search
CPC ..... E21B 33/068; E21B 34/02
See application file for complete search history.

(56) References Cited

U.S. PATENT DOCUMENTS

| | | | | |
|---|---|---|---|---|
| 2,250,244 | A | 7/1941 | Yancey | |
| 3,007,340 | A | 11/1961 | Kfaftson | |
| 4,184,504 | A | 1/1980 | Carmichael et al. | |
| 4,460,039 | A | 7/1984 | Knight | |
| 4,503,879 | A * | 3/1985 | Lazarus | 137/315.41 |

* cited by examiner

*Primary Examiner* — Robert E Fuller
(74) *Attorney, Agent, or Firm* — Christian Abel

(57) ABSTRACT

A tool for installation of units in connection with oil wells, comprising a housing (1) with an attachment device (12) for attachment to a well installation, a telescopic device (30, 31, 32) for extension of the tool, a torsional force transmission device (13) for rotation of an internal movable element (2) of the tool. The internal movable element (2) comprises a pressure face (21), which in an operative condition is exposed to a well pressure and a counter-pressure face (22), with a sealing arrangement (26) between the housing (1) and the internal movable element (2) provided between these pressure faces (21, 22) and devices (23) which are arranged in such a manner that a pressure can be applied to the counter-pressure face.

10 Claims, 2 Drawing Sheets

TOOL FOR INSTALLING UNITS IN A WELL

CROSS-REFERENCE TO RELATED APPLICATIONS

This application is a National Stage application under 35 U.S.C. §371 of International application PCT/NO2011/000029, filed 26 Jan. 2011.

FIELD OF THE INVENTION

The present invention relates to a tool for installation of units in connection with oil wells.

BACKGROUND OF THE INVENTION

Throughout the working life of a well, a number of units normally have to be installed and/or replaced. A plurality thereof are screwed into a well element. In order to release them, a tool is required which can grip and unscrew these units from engagement with the well element. An example of such an element is a valve which is located in the wellhead Christmas tree material, inside a gate valve, on an opening in the Christmas tree. In this case a tool has to grip the valve and unscrew it from engagement with the Christmas tree. During this process the tool will be exposed to the pressures under which the valve operates: the well pressure for the valve. This may be a casing pressure and/or other pressure in connection with the well.

The tool comprises a housing which is attached to the wellhead Christmas tree, and an internal element for unscrewing the valve from the Christmas tree must be rotated relative to the housing. This rotation gives rise to frictional forces, which are also partly dependent on the well pressure to which the tool is subjected. To carry out this rotation of the internal element places great demands on the system and with increasing force requirements, a larger force unit must be employed in order to achieve the desired rotation. This can be costly both with regard to production of the tool and during its use since the tool will also be heavier and therefore more difficult to handle. Thus there is a need for a tool where the rotation of the internal element is achieved with a relatively smaller tool.

The units which have to be installed or removed may often be difficult of access and the tool will normally have a telescopic function, where an inner movable element is moved in a telescopic function relative to the housing in order to become engaged with the unit and/or install/position the unit. If the distance between attachment point and engagement point is great, a possible solution is to make the tool as long as necessary in order to be able to carry out the activity. This results in a tool which may be difficult to handle and use on account of its great length. An alternative solution is to provide a telescopic function with several telescoping elements. A problem with such a telescopic member is to monitor where an outer end of the telescoping element is located. There is, moreover, also a need to retract the telescopic member into the housing so that the tool can be released. A simple solution is required here in order to achieve this.

SUMMARY OF THE INVENTION

An object of the present invention is to provide a tool which is more independent of frictional forces which arise on account of the well pressure to which the tool is exposed during operation. Furthermore, a second object is to provide a telescoping solution which can be retracted in a simple manner.

At least one of these objects is achieved with a tool as indicated in the following claims.

According to the invention a tool is provided for installation of units in connection with oil wells, comprising a housing with an attachment device for attachment to the well installation, a telescopic device for extension of the tool and a torsional force transmission device for rotation of an internal movable element of the tool. The well installation may, for example, be a wellhead Christmas tree, tubing, where the unit which has to be installed may be a valve, a plug, a measuring device or the like. The telescopic device may be arranged in such a manner that an internal movable element is moved relative to the housing, thereby enabling it to be moved so that an end of this movable element is moved past the attachment device for attachment, whereby it can extend into the well installation. The torsional force transmission device is arranged in such a manner that the internal movable element can be rotated relative to the tool housing. This rotation can be employed to screw or unscrew elements into or out of engagement with the well installation, thereby enabling them to be installed or removed. The attachment device may, for example, be a flange facing abutting a flange facing of the well installation and secured thereto. Alternatively, it may be threaded devices for securing or clamping devices or other means for securing the tool to the well installation.

According to an aspect of the invention the internal movable element comprises a pressure face, which in an operative condition is subjected to the well pressure and a counter-pressure face, with a sealing arrangement between these surfaces and devices which are arranged in such a manner that a pressure can be applied to the counter-pressure face. This pressure on the counter-pressure face is advantageous since it substantially cancels out the forces on the movable element as a result of the well pressure on the pressure face. Alternatively, as a consequence of the pressure exerted on the counter-pressure face, the forces may be slightly less than the forces as a result of the well pressure on the pressure face.

The pressure face and the counter-pressure face will naturally face in opposite directions and the combination of fluid pressure with these surfaces produces forces which thereby influence the internal movable element in opposite directions. The force influence on these two oppositely directed surfaces can therefore be configured so that they substantially cancel each other out or at any rate reduce the influence of the well pressure. This can be achieved by different configurations which will be discussed below. By cancelling forces in this way, frictional forces as a result of the fluid pressure from the well fluid on the movable element will no longer have such a great effect on the rotational movement of the internal movable element. The internal movable element can thereby be more easily rotated, which means that the forces required for rotating the element are less and that these forces in the torsional force transmission device can be employed to a greater extent for rotating the element which has to be removed or installed. With a solution of this kind the same effect can be achieved with regard to rotational forces on the element which has to be removed or installed with a smaller and lighter torsional force transmission device than with a tool which does not have these features. A smaller and lighter tool can thereby also be obtained for installing and removing units in a well installation. This will also save costs with regard to use of the tool, since less demanding lifting gear etc. will be required.

The force influence on the pressure face and the counter-pressure face can be configured in a number of ways so that the forces acting on the oppositely directed surfaces approximately cancel each other out or at least reduce the influence of the well pressure on the tool. The areas of the two oppositely directed surfaces, i.e. the pressure face and the counter-pressure face, may be approximately equal and an approximately equal pressure on the two areas will therefore cancel the forces. The areas may also be different, but with different fluid pressure on the two surfaces, cancellation or reduction may still be achieved of the forces acting on the internally movable element as a result of the well pressure.

According to an aspect of the invention the devices for pressurising the counter-pressure face may comprise an external pressure source. According to another aspect the devices may comprise a pressure transmission from the pressure face to the counter-pressure face. This means that the pressure in the well fluid acting on the pressure face also acts on the counter-pressure face. This can be achieved in several ways. According to an aspect the transmission may run through an internal bore in the movable element. The internal bore then extends from the pressure face to the counter-pressure face. Alternatively, the transmission may run through an external lead. The external lead may be an external pipe and/or a bore in the tool housing.

According to an aspect of the invention this internal bore from the pressure face to the counter-pressure face, whether it is located in the internal element or in the housing, may comprise a piston element arranged internally in the bore and a bend in the bore configured in such a manner that the piston element's movement in the bore is restricted in one direction. This direction is preferably such that fluid on the well pressure side will move the piston element towards the bend but no further. A configuration of this kind with the piston element and the bend in the bore prevents well fluid from escaping to the outside of the tool.

According to an aspect of the invention the internal movable element can be telescoped relative to the housing. This means that at least a part of the movable element moves from a retracted position to an extended position, where in the course of this movement it has moved relative to the housing and thereby also relative to the well installation since the housing is secured to the well installation.

According to the invention a tool is also provided for installation of units in connection with oil wells, comprising a housing with an attachment device for attachment to the well installation, a telescopic device for extension of the tool and a torsional force transmission device for rotation of an internal movable element of the tool, where the movable element comprises a telescopic device for extending at least a part of the internal movable element and a return system for retracting this part of the internal element. In such a solution, the internal movable element comprises an outer part and at least two internally located parts, at least one intermediate part and an inner part. These parts are arranged at least partly inside one another, so that a part which is arranged within an externally located part in an initial position is located approximately inside the externally located part. According to the invention the return system comprises a pressure face both on the internally located part and the outer part or an externally located part, which surfaces are facing in opposite directions. When the forces applied to these pressure faces become greater than the forces holding the internally located part in a telescoped position, these forces will retract the internally located part to an initial position. The initial position is a position approximately inside the outer part or an externally located part of the internal movable element. The pressure on the pressure faces may be provided by elastic elements, such as for example springs and/or a fluid, liquid or gas, pressurised in a chamber. In an embodiment the pressure faces may be facing in opposite directions and facing each other and be arranged at opposite ends of a chamber which can be pressurised with a fluid for retraction of the movable element to an initial position. The chamber will have a varying volume since the intermediate part or inner part is moved relative to the outer part or external intermediate part. Alternatively, the pressure faces may be facing each other and have an intermediate compression spring or be facing away from each other and have an intermediate tension spring.

Thus according to the invention the movable element comprises at least three reciprocally movable parts, an outer part and at least two internally located parts, which constitute at least an intermediate part and an innermost part, and a return system comprising a pressure face in the outer part, an externally arranged pressure face on the innermost part and an internally and an externally arranged pressure face on the at least one intermediate part, with devices which enable the pressure faces to be influenced by a pressure between them, thereby providing a retraction force for retracting the internally located parts, i.e. the at least one intermediate part and the innermost part, to an initial position.

According to an aspect of the invention the at least one intermediate part comprises a longitudinal bore with an opening to an externally located pressure chamber in connection with the externally arranged pressure face on the intermediate part and an opening to an internally located pressure chamber in connection with the internally arranged pressure face on the intermediate part arranged at each end of the intermediate part. The opening to the internally located pressure chamber is arranged at an end of the intermediate part, which end in a telescoped condition of the internal movable element is moved out of externally located parts.

Some aspects of the present invention are explained above, all of which can provide a tool which is lighter and easier to handle. A tool may be envisaged which has a pressure-compensated inner movable part, without being telescopable by means of the above-mentioned retraction system. A tool is also conceivable which is telescopable by means of the above-mentioned retraction system without the inner movable part being pressure-compensated.

BRIEF DESCRIPTION OF THE DRAWINGS

The invention will now be explained by means of non-limiting embodiments with reference to the attached figures, in which.

DETAILED DESCRIPTION

Figure 1:
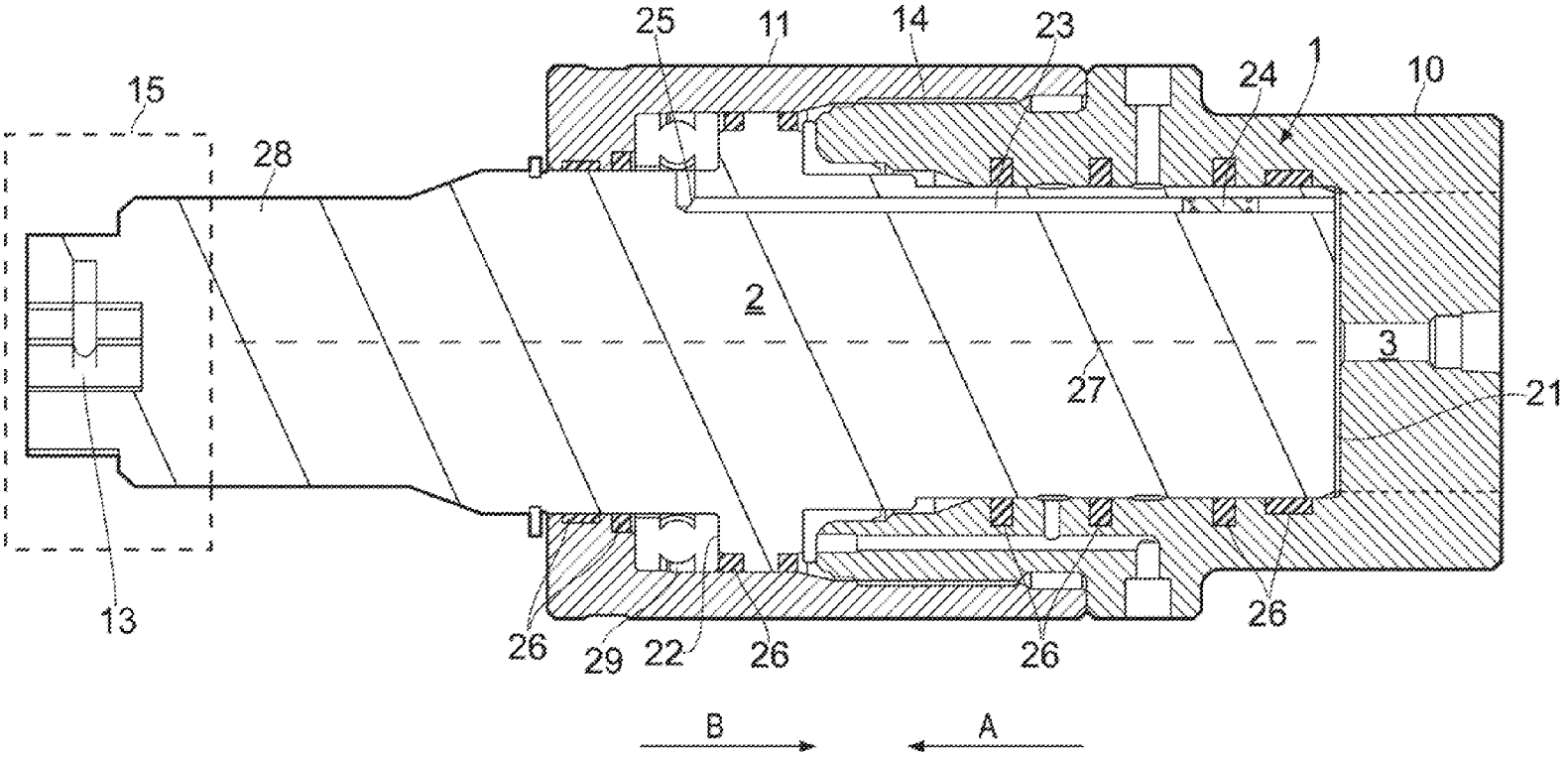
FIG. 1 illustrates a part of a tool where the internal movable element is pressure-compensated.

FIG. 1 illustrates a part of a tool according to the invention. The tool comprises a housing 1, which can be attached to a well installation (not shown) by attachment devices 12 (see FIG. 2). The housing 1 comprises a first housing part 10 which is secured to the well installations and a second housing part 11 which is connected to the first housing part 10 via a threaded connection 14. Inside the housing an internal movable element 2 is mounted. In the illustrated example, this internal movable element 2 is permitted to be rotated about an axis 27 in such a manner that it is moved relative to the housing which stands still. The internal movable element 2 has an outer end 28 extending out of the housing 1. This outer end 28 comprises a torsional force transmission device 13 which enables it to be connected to a unit 15 which can rotate the internal movable element 2. This unit 15 can be operated manually or hydraulically, electrically or in another suitable manner.

Figure 2:
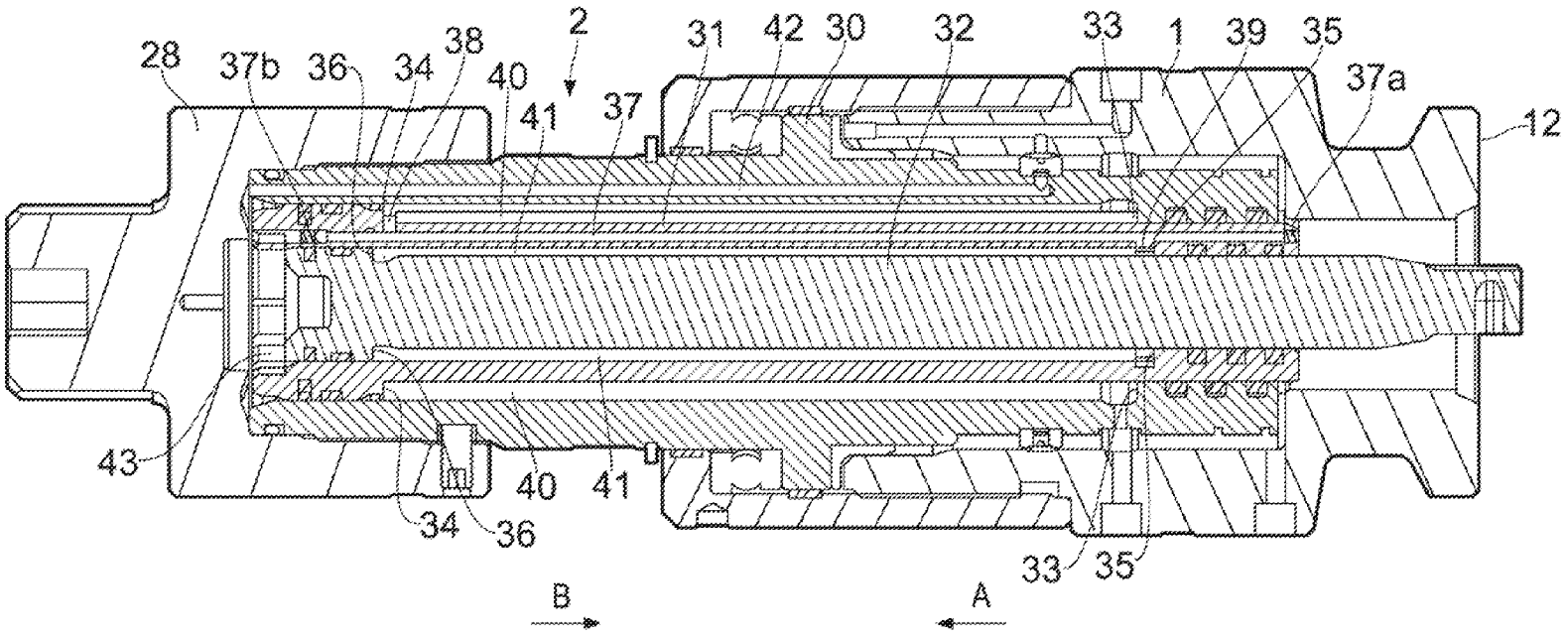
FIG. 2 illustrates a version of a tool where the internal movable element comprises telescopable parts.

According to the invention the internal movable element 2 comprises a pressure face 21, which is exposed to the pressure in a well fluid 3 when the tool is in use. The pressure of the well fluid 3 on the pressure face 21 will apply a pressure to the internal movable element 2 which acts in direction A as indicated in the figure. According to the invention the internal movable element 2 further comprises a counter-pressure face 22. The pressure face 21 and the counter-pressure face 22 are facing in opposite directions, and a pressure on the counter-pressure face 22 will exert a force on the internal movable element 2 which acts in a direction B as indicated in the figure. The internal movable element 2 further comprises an internal bore 23 extending from the pressure face 21 and inside the internal movable element 2 to the counter-pressure face 22. As illustrated in the example, the internal bore 23 has a straight bore from the pressure face 21 inwards in the element 2, which continues in a bend 25 and radially out to a chamber 29 comprising the counter-pressure face 22. The chamber 29 is composed of the housing 1 and the element 2 and is annular in shape. The counter-pressure face 22 forms one side of this chamber 29. In the bore 23 a piston 24 is further provided, which is permitted to move in the bore 23. The pressure in the well fluid 3 will then be transferred via the piston 24 to a fluid located on the other side of the piston 24 inside the bore 23 and via this to the counter-pressure face 22. In an embodiment the counter-pressure face 22 and the pressure face 21 may have substantially similar areas, and with a solution according to the invention the force influence which the well fluid has on the internal movable element will therefore be approximately cancelled. A number of seals 26 are further mounted in the transitions between the various parts, the internal movable element and the housing, thereby providing barriers between the well fluid 3 and the environment. The internal movable element 2 may be provided with devices (not shown) at the well fluid end, in order to grip the unit which has to be installed/removed. In the figure this end is approximately covered by the housing material, but only with a small opening to the well pressure, although this opening may be made much larger as indicated by the dotted line as illustrated in FIG. 2. In an example this opening may also be a square or have another external configuration for connecting it to a valve which, for example, is secured by a snap ring.

FIG. 2 illustrates a version of a tool where the internal movable element 2 has a telescopic function and a return system The internal movable element 2 comprises an outer part 30 and two internally located parts, an intermediate part 31 and an inner part 32, all of which are shown in an initial position, where the parts are arranged inside one another. The parts are arranged telescopingly, so that the intermediate part 31 can be moved in the longitudinal direction of the tool, direction B in the figure, to an extended position (not shown), where an end of the intermediate part 31 is still located inside the outer part 30 and the opposite end is moved out of the outer part 30. The inner part 32 is also moved from a position inside the intermediate part to a position where only one end is located inside the intermediate part 31 and the rest of the inner part 32 is located outside the intermediate part 31. The outer part 30 can be rotated relative to the housing 1, but not moved in the longitudinal direction of the tool, i.e. in the directions A and B as indicated in the figure. On rotation of the outer part 30, internally located parts 31, 32 will also rotate.

In order to move the internally located parts 31, 32 out of the outer part, a fluid is supplied through the discharge bore 42 in the outer part, to the rear edge of the inner ends of the internally located parts 31, 32. The rear edge of these parts 31, 32 is pressurised by this fluid and moves the parts 31, 32 in a direction out of the outer part 30. The internally located parts are secured to each other at the rear edge by an interconnecting device 43. This interconnecting device 43 will assist the intermediate part 31 in becoming fully extended relative to the outer part 30 before the inner part 32 is moved relative to the intermediate part 31. The interconnecting device 43 holds the internally located parts together with a given force and if the interconnecting device is subjected to a greater force, the parts will be released from one another. This release force is greater than the force from the fluid required for moving the intermediate part relative to the outer part. When the intermediate part is moved to its end stop, fully extended, by applying a slightly greater pressure it will be possible to release the interconnecting device, thereby enabling the inner part to be moved further relative to the intermediate part. This interconnecting device 43 may be a magnetic device, rupture pins, friction coupling, etc.

When the parts in the internal movable element 2 are telescoped out into an extended position, they should also advantageously be capable of being retracted to the initial position. According to the invention the internal movable element 2 also comprises a return system. The outer part 30 has an internally arranged pressure face 33 which forms an end surface of a first telescopic chamber 40. The intermediate part 31 has an externally arranged pressure face 34 which forms an opposite end surface of the first telescopic chamber 40. The first telescopic chamber 40 will have varying volume since the intermediate part 31 moves telescopingly relative to the outer part 30. When the telescopic chamber 40 is pressurised, the forces acting on the pressure faces will assist in retracting the intermediate part 31 into the outer part 30. Furthermore, there is an opening 38 between this telescopic chamber 40 and a bore 37 in the intermediate part 31. The opening 38 is an outwardly facing opening 38 relative to the bore 37. The bore 37 also has an inwardly facing opening 39 leading to a second telescopic chamber 41 arranged between the intermediate part 31 and the inner part 32. In another embodiment the inner part 32 may constitute an intermediate part. The intermediate part 31 has an internally arranged pressure face 35 which forms an end surface in this second telescopic chamber 41. This pressure face 35 is further arranged at the same end of this chamber 41 as the inwardly facing opening 39 of the bore 37 in the intermediate part. The inner part 32 is provided with an externally arranged pressure face 36, which forms an end surface of the second telescopic chamber 41. This pressure face 36 is arranged at the opposite end of the second telescopic chamber relative to the internally arranged pressure face 35 of the intermediate part 31. When this second telescopic chamber 41 is pressurised, the inner part 32 will be moved into the intermediate part 31. The telescopic chamber 41 will vary its size depending on the relative position of the two parts. The bore 37 in the intermediate part 31 extends along the whole length of the part. End plugs 37*a*, 37*b* are mounted at the end of the bore 37. The openings 38, 39 are arranged at opposite ends of the intermediate part 31. The distance between the openings 38, 39 defines how long an extension the intermediate part 31 gives to the telescopic function. With a solution with the bore 37 and the bore 42, hydraulics may be supplied at the same point on the tool.

The invention has now been explained with reference to the attached figures. A tool may have pressure compensation according to FIG. 1 and/or a return system for the telescopic parts as indicated in FIG. 2, advantageously both systems as this provides a relatively light and practical tool with large range and capacity. A person skilled in the art will also appreciate that changes and modifications may be made to the illustrated embodiments which are within the scope of the invention as defined in the following claims. For example, the internal movable element may have two, three or more intermediate parts.

The invention claimed is:

1. A tool for installation of units in connection with oil wells, comprising a housing with an attachment device for attachment to a well installation, an internal movable element comprising a telescopic device for extension of the tool, a torsional force transmission device for rotation of the internal movable element of the tool, where the internal movable element comprises a first pressure face, which in an operative condition is exposed to a well pressure and a counter-pressure face, with a sealing arrangement between the housing and the internal movable element provided between the first pressure face and the counter-pressure face, wherein the internal movable element further comprises a pressure balancing system which is arranged in such a manner that a pressure can be applied to the counter-pressure face, the internal movable element further comprising a return system for retracting at least one telescoped internally located part of the telescopic device to an initial position arranged substantially inside an outer part of the telescopic device of the movable element, the return system comprising at least one pair of opposite-facing internal pressure faces, at least one of the pair of internal pressure faces is disposed on the internally located part and at least the other of the pair of internal pressure faces is disposed on the outer part, and pressure devices for applying a pressure to the internal pressure faces which exert forces on the at least one telescoped internally located part, causing it to be retracted to the initial position.

2. The tool according to claim 1, wherein the pressure devices are pressurized by an external pressure source.

3. The tool according to claim 1, wherein the pressure devices comprise a pressure transmission line extending from the first pressure face to the counter-pressure face.

4. The tool according to claim 3, wherein the transmission line runs through an internal bore in the movable element.

5. The tool according to claim 4, wherein the bore comprises at least one bend and an internal movable piston, where the piston's movement in one direction is restricted by the bend.

6. The tool according to claim 3, wherein the transmission line runs through an external lead.

7. The tool according to one of the preceding claims, wherein at least a part of the telescopic device can be telescoped relative to the housing.

8. The tool according to claim 1, wherein the pressure devices for applying pressure to the at least one pair of opposite-facing internal pressure faces comprise an elastic element, preferably at least one spring element.

9. The tool according to claim 1, wherein said at least one telescoped internally located part of the telescopic device comprises an intermediate part and an inner part, and wherein said at least one pair of opposite-facing internal pressure faces comprise a second pressure face arranged internally in the outer part, a third pressure face arranged externally on the intermediate part, a fourth pressure face arranged internally on the intermediate part, and a fifth pressure face arranged externally on the inner part, and wherein the return system further comprises a bore in the intermediate part, with an opening to an externally located pressure chamber in connection with the third pressure face and an opening to an internally located pressure chamber in connection with the fourth pressure face, which openings are arranged at each end of the intermediate part.

10. The tool according to claim 9, wherein the opening to the internally located pressure chamber is arranged at an end of the intermediate part, which end in a telescoped condition is moved out of the outer part of the internal movable element.

* * * * *